US006684790B2

(12) United States Patent
Bestmann et al.

(10) Patent No.: US 6,684,790 B2
(45) Date of Patent: Feb. 3, 2004

(54) METHOD OF DETERMINING THE AREA COVERAGE OF PRINTING PLATES

(75) Inventors: Günter Bestmann, Altenholz (DE); Dietrich Blum, Raisdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/348,435

(22) Filed: Jan. 21, 2003

(65) Prior Publication Data

US 2003/0136288 A1 Jul. 24, 2003

(30) Foreign Application Priority Data

Jan. 19, 2002 (DE) ..... 102 01 918

(51) Int. Cl.[7] ..... B41F 1/54

(52) U.S. Cl. ..... 101/484; 101/485; 101/486; 358/527

(58) Field of Search ..... 101/484, 485, 101/486; 358/521–527

(56) References Cited

U.S. PATENT DOCUMENTS 5,128,879 A * 7/1992 Greve et al. ..... 382/112
5,255,085 A 10/1993 Spence ..... 358/527
5,309,246 A * 5/1994 Barry et al. ..... 358/1.9
5,835,244 A 11/1998 Bestmann ..... 358/523

FOREIGN PATENT DOCUMENTS

DE 43 35 143 A1 4/1995
EP 0 687 102 A2 12/1995
JP 2001086359 A * 3/2001 ..... H04N/1/60

* cited by examiner

*Primary Examiner*—Andrew H. Hirshfeld
*Assistant Examiner*—Minh Chau
(74) *Attorney, Agent, or Firm*—Laurence A. Greenberg; Werner H. Stemer; Gregory L. Mayback

(57) ABSTRACT

A method of determining the area coverages of a printing plate for controlling the quantities of ink in inking zones of a printing press, includes, to produce the plate from existing printed-sheet data, producing color-value printing data based upon a standard raster system, converting the printing data by a raster generator into rastered printing data, exposing the rastered printing data onto film material or a printing plate by an exposer, using various raster systems with different dot gains on the plate, in the raster generator, depending on the raster system used, applying an associated dot gain correction curve and a linearization correction curve to the color-value printing data, and supplying an area coverage calculation unit with coarse color-value image data derived from the color-value printing data, a dot gain correction curve for each raster system used, and correction location data describing in which areas of the plate which raster system is used.

9 Claims, 4 Drawing Sheets

METHOD OF DETERMINING THE AREA COVERAGE OF PRINTING PLATES

BACKGROUND OF THE INVENTION

FIELD OF THE INVENTION

The invention pertains to the field of electronic reproduction technology and relates to a method of determining the area coverage of printing plates. The area coverage is the proportion of the area of a printing plate that is covered with printing ink during printing, which ink is, then, transferred to the printing material (e.g., paper). For an image, the area coverage is given by the proportion of the area that is covered by the halftone dots, in relation to the total area of the image. For a text, the area coverage is given by the proportion of the area that is covered by the lines and curves of the letters, in relation to the total area of the text block. Global and local area coverages, determined strip by strip, are needed for presetting the inking zones in the inking unit of an offset printing press. For the inking zones divided up over the width of the printing plate, the quantity of printing ink fed in must be set such that it corresponds to the quantity of printing ink taken off the corresponding strip on the printing plate, which, in turn, depends on the area coverage of the printing plate in the relevant strip, that is to say, on the size of the halftone dots, the thickness of the lines of the text and so on.

In reproduction technology, printing originals for printed pages are produced that contain all the elements to be printed, such as texts, graphics, and images. For colored printing, a separate printing original is produced for each printing ink, which contains all the elements that are printed in the respective color. For four-color printing, these are the printing inks cyan, magenta, yellow, and black (CMYK). The printing originals, separated in accordance with printing inks, are also referred to as color separations. The printing originals are generally scanned and exposed by an exposer onto films, which are, then, processed further in order to produce printing plates for printing large editions. Alternatively, the printing originals may also be exposed directly onto printing plates in special recorders, or they are output directly to a digital printing press as digital data.

According to the prior art, the printing originals are reproduced electronically. Here, images are scanned in a color scanner and stored in the form of digital data. Texts are produced by text processing programs and graphics by symbol programs. Using a layout program, the image, text, and graphics elements are assembled to form a printed page. Following separation into the printing colors, the printing originals are, then, present in digital form. Nowadays, the page description languages Postscript and Portable Document Format (PDF) are largely used as data formats for describing the printing originals. Before the recording of the printing originals, such a description is converted into a description in which the image points are each assigned a gray value if the printed page is printed in black and white or, respectively, the image points are each assigned color values if the printed page is a colored print. If the printed page is printed in the four printed colors CMYK, then the amounts of ink to be printed in each image point are described by four color values. For example, four bytes are produced for each image point, corresponding to the four color values. The color values, then, have one of 256 possible steps between 0 and 255. The printing-original data for a printing color can, therefore, also be understood as a "black and white page," whose "gray values" specify the amount of the associated printing color in each image point.

In the printing press, printing ink in the form of a thin layer is applied to the printing material by the printing points on the printing plate. The task of the inking unit is to supply the printing points continuously with fresh color so that the printing process can be maintained. The quantity balance between feed and discharge of ink must be balanced if color density fluctuations in the printed image are to be avoided. In addition to the balanced quantity balance, the constancy of the ink layer thickness on the printing points of the printing plate or the printed points on the printing material is of critical importance for the printing quality. To ensure the constancy, in an offset printing press, the feed of the printing ink is set zone by zone with an inking zone control system. The printable width of the printing press is subdivided into inking zones, for which the quantity of ink fed in can be controlled separately. Each inking zone is, for example, 32.5 mm wide. To control the quantity of ink, a resilient ink knife is brought, for example, by zone screws, to a different distance from the ink ductor roll that, as a result, picks up a different quantity of ink from the ink fountain in the individual zones. According to another system, there is an eccentric actuating cylinder in each inking zone, whose distance from the ink ductor roll is set differently in each zone.

To be able to set the actuating devices in the inking zones correctly, it is necessary to know what quantity of ink in the individual inking zones is taken off by the printing plate and transferred to the printing material. This quantity is calculated from the area coverage of the printing plate in the inking zones. The printing plate is subdivided into strip-like regions by the inking zones, that is to say, the area coverages in these strips must be determined. According to the prior art, the print-ready printing plate, before being clamped into the printing press, is scanned in a printing-plate reader to determine the area coverages in the strips that correspond to the inking zones. The values determined are transmitted to the control desk of the printing press, and the actuating devices for the feed of the printing ink are set appropriately from there for the inking zones. A further prior art method derives the area coverages of the inking zones from the printing-original data that are produced during electronic reproduction. Such a process saves the investment costs for a printing-plate reader and expenditure of time for scanning the printing plates before starting printing.

SUMMARY OF THE INVENTION

It is accordingly an object of the invention to provide a method of determining the area coverage of printing plates that overcomes the hereinafore-mentioned disadvantages of the heretofore-known devices and methods of this general type and that provides a method of producing coarse color-value image data with which the area coverages for setting the inking zone can even be determined for the case in which various raster systems are used on a printed sheet.

With the foregoing and other objects in view, there is provided, in accordance with the invention, a method for producing a printing plate, including the steps of determining area coverages of the printing plate for controlling quantities of ink in inking zones of a printing press by producing color-value printing data from existing printed-sheet data based upon a standard raster system, converting the color-value printing data into rastered printing data with a raster generator, exposing the rastered printing data onto one of film material and the printing plate with an exposer, utilizing various raster systems with different dot gains on the printing plate, dependent upon a raster system used, applying in the raster generator an associated dot gain correction curve and a linearization correction curve to the color-value printing data, the associated dot gain correction curve describing a change in a dot gain between the standard raster system and the raster system used, the linearization correction curve describing a relationship between raster point sizes in the rastered printing data and the raster point sizes exposed, and determining the area coverages of the printing plate in a unit for area coverage calculation, the unit for area coverage calculation being supplied with coarse color-value image data derived from the color-value printing data, a dot gain correction curve for each raster system used, and correction location data describing which raster system is used in given areas of the printing plate.

With the objects of the invention in view, there is also provided a method for producing a printing plate, including the steps of determining area coverages of the printing plate for controlling quantities of ink in inking zones of a printing press by producing color-value printing data from existing printed-sheet data based upon a standard raster system, converting the color-value printing data into rastered printing data with a raster generator, exposing the rastered printing data onto one of film material and the printing plate with an exposer, utilizing various raster systems with different dot gains on the printing plate, dependent upon a raster system used, applying in the raster generator an associated dot gain correction curve and a linearization correction curve to the color-value printing data, the associated dot gain correction curve describing a change in a dot gain between the standard raster system and the raster system used, the linearization correction curve describing a relationship between raster point sizes in the rastered printing data and the raster point sizes exposed, and determining the area coverages of the printing plate in a unit for area coverage calculation, the unit for area coverage calculation being supplied with coarse raster image data derived from the rastered printing data and the linearization correction curve.

In accordance with another mode of the invention, the correction location data for each image point contains an identifier regarding which raster system is used in the image point.

In accordance with a further mode of the invention, the correction location data is embedded in the coarse color-value image data.

In accordance with an added mode of the invention, the coarse color-value image data is transmitted to a measuring system on the printing press as predefinition values for colors to be achieved in a print.

In accordance with a concomitant mode of the invention, the exposer is integrated into the printing press.

Other features and modes that are considered as characteristic for the invention are set forth in the appended claims.

Although the invention is illustrated and described herein as embodied in a method of determining the area coverage of printing plates, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
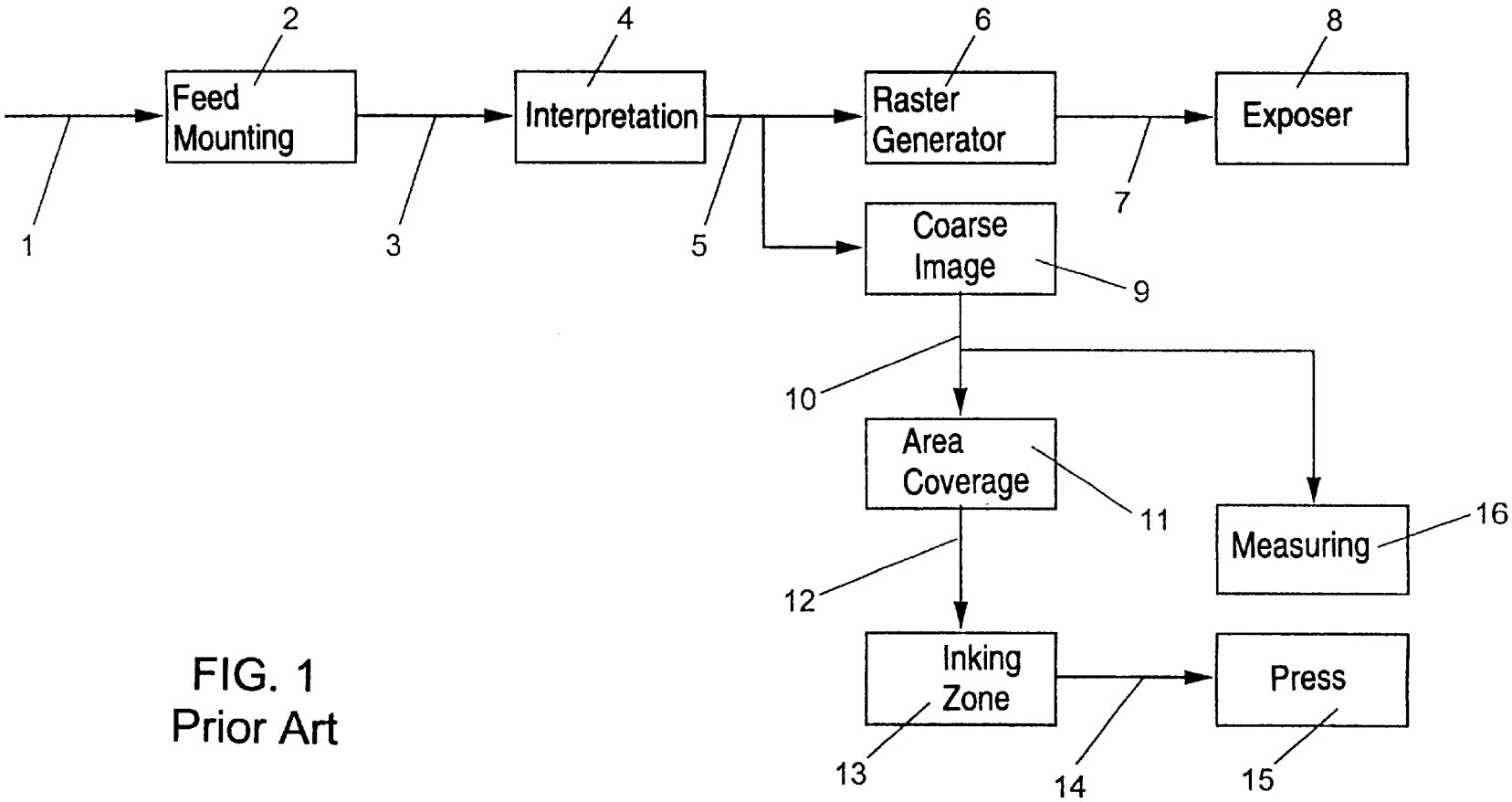
FIG. 1 Prior Art
FIG. 1 is a block circuit diagram of a prior art working sequence in the production of printing-original data.

Referring now to the figures of the drawings in detail and first, particularly to FIG. 1 thereof, there is shown a working sequence predominantly used in the prior art during the production and recording of printing-original data. The printed-page data 1, which is described in the page description language PostScript or PDF, for example, is fed to a feed or sheet mounting system 2, which can be a computer specifically optimized for such a task or a program on a standard computer. The printed-page data 1 describes the content of a single printed page. It is produced in a prior process by an application program for assembling a printed page (layout program). The sheet mounting system 2 assembles a plurality of printed pages in accordance with an imposition scheme to form a printed sheet and produces the printed-sheet data 3, which describes the content of a printed sheet, for example, likewise in PDF data format. In addition to the printed pages, the printed-sheet data 3 also contains register crosses, cutting and folding marks, and a print control strip at the edge of the printed sheet. The imposition scheme depends on how the printed sheet is folded and cut after being printed, in order, for example, to produce a multi-page brochure or a folded sheet.

In an interpretation system 4, the printed-sheet data 3 present in a page description language is analyzed and interpreted and, in the process, converted into color-value printing data 5, that is to say, into a data format that, for each image point, specifies the color values of the color separations in accordance with the number of printing inks used. For the four standard printing inks CMYK, the color-value printing data 5 contain four bytes for each image point, for example, which each specify the quantity of the color to be printed. The color-value printing data 5 is, therefore, also referred to as "byte map." The resolution of the color-value printing data 5 generally corresponds to the resolution with which the printing originals are to be recorded on film material or directly on a printing plate, for example, the resolution is 100 image points/mm. However, the data from the color-value printing data 5 can also be produced in another, for example, lower, resolution and interpolated to the resolution of the film or plate recorder only before recording. Furthermore, the data from the color-value printing data 5 can be compressed by a data compression system to save storage space, for example, using run-length coding or using the Joint Photographic Experts Group (JPEG) method.

The data from the color-value printing data 5 are fed, in a further step, to a raster generator 6, which converts the color values into areas filled with raster points and transfers them as rastered printing data 7 to the exposer 8, for example, a plate exposer, which records the rastered printing data 7 directly onto a printing plate. The production of the raster points is carried out, for example, in a conventional way by comparing the color separation values with a threshold value matrix that contains the configuration and size of the raster points. The raster point size and/or the number of raster points per unit area, depending on the raster system used, is varied in this case in accordance with the color separation value in the color-value printing data 5. The rastered printing data 7 has a high resolution, for example, 100 points/mm (=2540 dpi) and are described with one bit for each image point and color separation. The bit indicates whether the corresponding point on the printing plate is exposed or not. The rastered printing data 7 is, therefore, also referred to as a "bitmap."

In a unit for producing a coarse image 9, the color-value printing data 5 is used to produce a printing image in reduced resolution, as defined, for example, in the International Cooperation for Integration of Prepress, Press, and Postpress (CIP3) Standard (Specification of the CIP3 Print Production Format, Version 3.0, Jun. 2, 1998). The result is coarse color-value image data 10 with a resolution of, for example, 50.8 dpi, which contains all the elements that are subsequently exposed on the plate. The coarse color-value image data 10 have two functions. Firstly, in a unit for area coverage calculation 11, the coarse color-value image data 10 are used to calculate the area coverage data 12, by summing the color separation values of the coarse color-value image data 10 in the strip regions that correspond to the inking zones and refer to the total area of the respective strip. From the area coverage data 12, in a unit for calculating the inking zone settings 13, the inking zone setting data 14 is, then, determined and transmitted to the printing press 15, where the actuating devices in the individual inking zones are subsequently set accordingly. Secondly, the coarse color-value image data 10 serve as predefinition values for the colors to be achieved subsequently in the print. For such a purpose, the coarse color-value image data 10 are transferred to a measuring system 16 in the control desk of the printing press 15, where they are converted into the LAB color system, for example. Following the measurement of a finished printed sheet, the measuring system 16 can compare the predefinition values with the colors actually achieved in the print and, if necessary, change control parameters of the printing press 15.

As is usual in printing, the color separation values of the color-value printing data 5 are specified as halftone percentages between 0% and 100%, that is to say, the value 0% means that no color is printed, and the value 100% means that the full quantity of color is printed. If the color separation values are stored as bytes, 0% corresponds for example to the binary number 0 and 100% to the binary number 255. If the raster generator 6 produces a conventional raster with halftone dots disposed regularly but whose size is varied, the halftone percentage also corresponds to the size of the raster point recorded on the printing plate in the exposer 8. To achieve this, the color-value printing data 5 is linearized in a conventional way during the conversion into the rastered printing data 7. For such a purpose, the color separation values are changed in the raster generator 6 such that the nonlinearity in the transfer characteristic of the exposer 8 is compensated for. Then, a color separation value of R % will also be recorded on the printing plate as a raster point of size R % if the exposer 8 is a printing-plate exposer, that is to say, the color-value printing data 5 and the coarse color-value image data 10 derived therefrom reproduce the raster point sizes on the printing plate correctly. In the event, the area coverage data 12 calculated from the coarse color-value image data 10 correspond to the actual area coverage on the printing plate and are a suitable measure of the quantity of ink picked up in the printing press 15.

Figure 2:
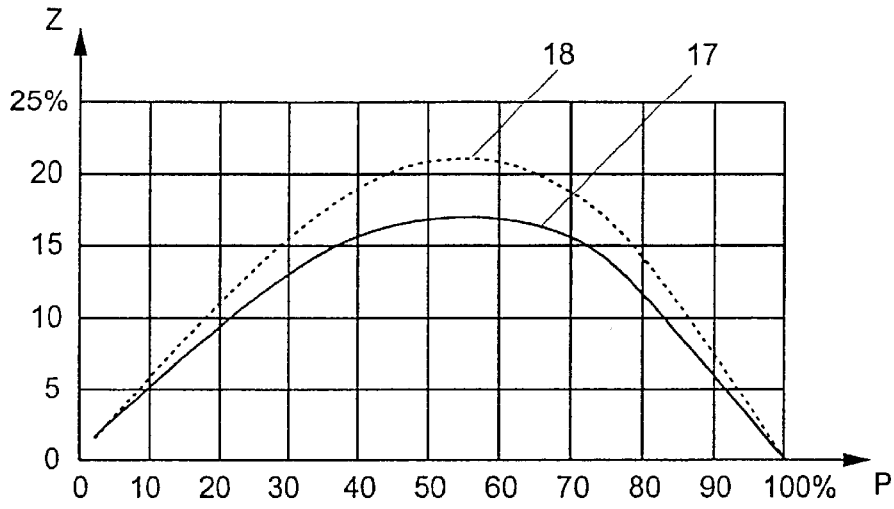
FIG. 2 is a graph illustrating dot gain curves for various screen systems.

However, the raster point sizes on the printing plate do not correspond to the size of the printed halftone dots. The printed halftone dots are, generally, larger than the raster points on the printing plate, which is described by a dot gain curve. FIG. 2 shows the dot gain curve 17 for a standard raster, defined as a raster frequency of 60 raster points/cm, referred to as a 60 raster. For various raster frequencies and various raster methods, different dot gain curves apply. For frequency-modulated rastering, the dot gain is significantly higher than for conventional amplitude-modulated rastering. In the ISO Standard 12647-2 "Graphic technology—Process control for the manufacture of half-tone color separations, proof and production prints—Part 2: Offset lithographic processes", dot gain curves for offset printing are described. The dot gain curve 17 indicates, for a raster point size of P % on the printing plate, that the halftone dot in the print is Z % larger, that is to say, has a size of D=(P+Z) %. For example, if a raster dot on the printing plate with a size P=40% has a dot gain of Z=16%, printing will, therefore, be carried out with the size D=56%. In electronic reproduction technology, the expected dot gain for a standard raster is normally already taken into account when producing the printed-page data 1, that is to say, if the color desired in the printed result requires a printed halftone dot size of D=56%, a half tone percentage of P=40% will be reproduced and exposed on the printing plate. Such standardization simplifies reproduction work substantially. If printing is, subsequently, carried out in a different raster system, for example, an 80 screen, the changed dot gain is taken into account when exposing the printing plates.

FIG. 2 also shows the dot gain curve 18 for an 80 screen, which has a greater dot gain than the 60 screen. For a raster point on the printing plate with a size P=40%, the result in the 80 screen is a dot gain of Z=19%, that is to say, a printed halftone dot of D=59%. However, because a printed halftone dot size of D=56% was intended during the reproduction, the increased dot gain of the 80 screen must be compensated for when exposing the printing plate such that the result in the print is, again, a halftone dot size of D=56%. Otherwise, the finished printed sheet would have the wrong colors. For such a purpose, according to the prior art, a corresponding reduced raster point size for the plate exposure is produced in the raster generator 6 when converting the color-value printing data 5 into the rastered printing data 7.

Figure 3:
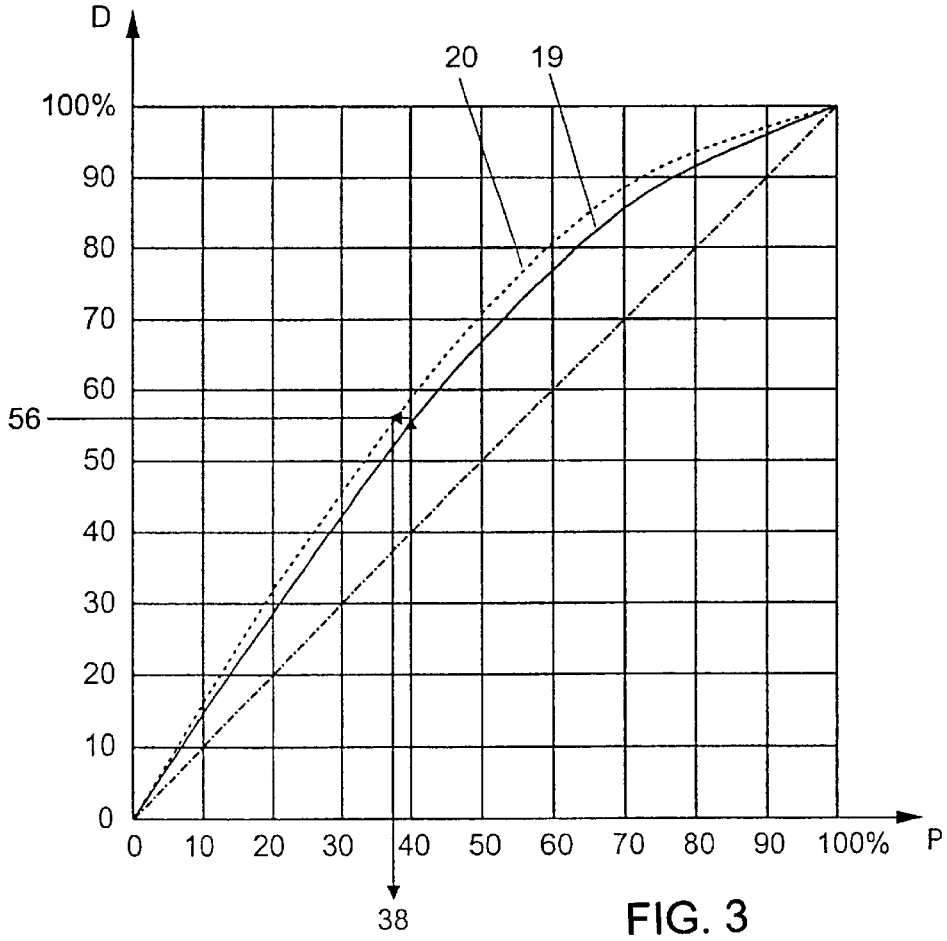
FIG. 3 is a graph illustrating print transfer curves for various screen systems.
Figure 4:
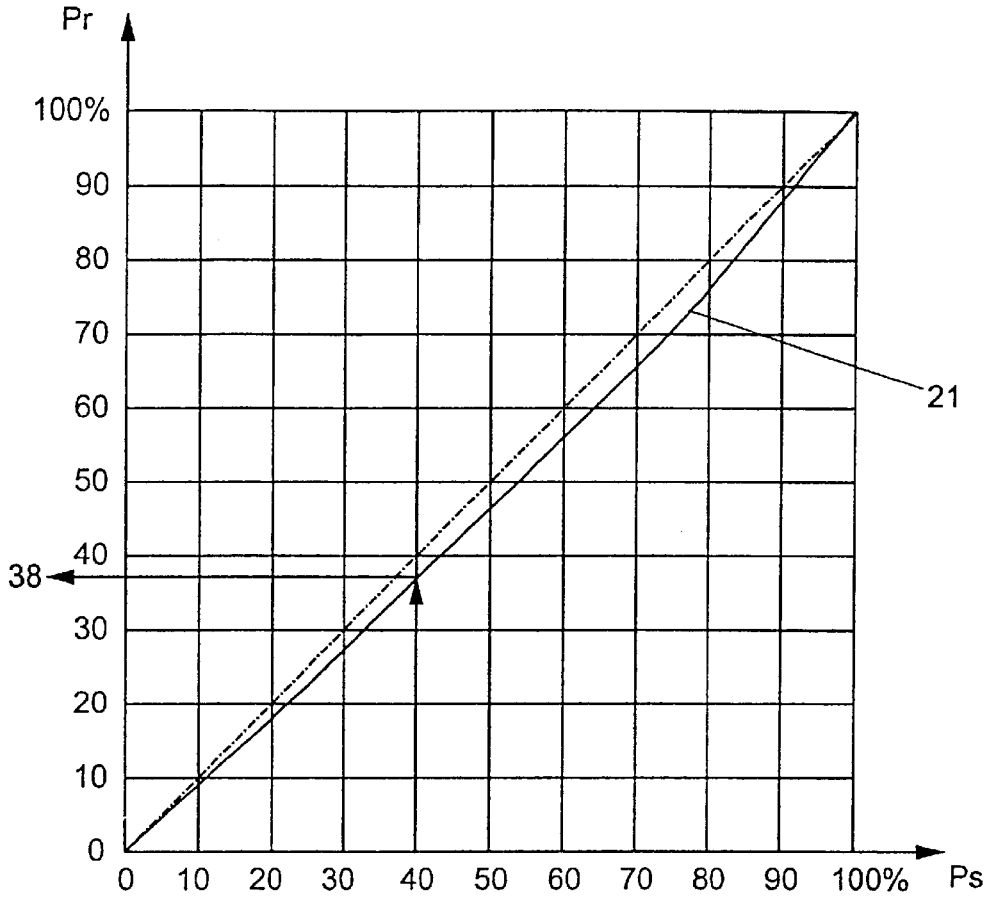
FIG. 4 is a graph illustrating a dot gain correction curve for the screen system actually printed.

FIG. 3 illustrates this using the print transfer curve 19 for the 60 screen and the print transfer curve 20 for the 80 screen. The print transfer curves describe the relationship between the printed halftone dot size D and the raster point size P on the printing plate. They are given in a simple way from the dot gain curves by adding the raster point size P on the printing plate and the dot gain Z, that is to say, D=P+Z. It can be gathered from the print transfer curve 20 that, to produce a printed halftone dot size of D=56%, a raster point size P=38% is required on the plate. Therefore, to compensate for the higher dot gain of the 80 screen, the halftone percentage Ps=40% produced in the reproduction system based upon the standardized 60 screen is reduced to Pr=38% in the raster generator 6. A corresponding correction is performed based upon comparing the print transfer curve 20 of the screen used with the print transfer curve 19 of the standard screen for all the halftone percentages produced by the reproduction system. A dot gain correction curve 21 is expediently derived from the comparison between the print transfer curves 19 and 20, as shown in FIG. 4. The dot gain correction curve 21 describes the relationship between the half tone percentage Ps, as produced in the reproduction system based upon the standard raster, and the exposed raster point size Pr, to which the halftone percentage Ps is corrected in the raster generator 6, in order to achieve the same colors in the finished printed product in spite of the changed dot gain of the raster actually printed.

The problem now arises, however, that the coarse color-value image data 10 derived from the color-value printing data 5 does not reproduce the raster point sizes actually exposed, and, therefore, the correct area coverages for setting the inking zones can no longer be determined. To achieve a good presetting for the inking zones, the area coverage data 12 must be determined with an absolute accuracy from one half tone percentage. However, the coarse color-value image data 10 continue to be suitable, furthermore, as predefinition values for the measuring system 16 in the control desk of the printing press 15 because they still specify the colors to be achieved in the print. This problem has hitherto been solved by the print transfer curves 19 and 20 and the dot gain curves 17 and 18 of the raster system on which the reproduction is based, and of the raster system actually printed, being used to determine a dot gain correction curve 21, which places the half tone percentages produced by the reproduction system and the raster point sizes actually exposed in a relationship. The dot gain correction curve 21 is, for example, determined in accordance with the method explained in connection with FIG. 3 and FIG. 4. The dot gain correction curve 21, together with the coarse color-value image data 10, are additionally transmitted to the unit for area coverage calculation 11. There, by using the dot gain correction curve 21, the dot gain correction that was performed in the raster generator 6 before the exposure can be completed and, therefore, by using the coarse color-value image data 10, the raster point sizes actually exposed can be determined as a basis for the correct calculation of the area coverages.

However, this prior art method is a solution only for the case in which the same raster system is used over the entire printed sheet. For the case that increasingly occurs, in which a printed sheet is to be printed with different raster systems, for example, with entire printed pages that are printed in different rasters, or with different rasters within a printed page, hitherto, no solution existed with which the coarse color-value image data 10 can be produced such that they, first, form the basis for the correct calculation of the area coverages and, second, can be used as predefinition values for the colors to be achieved in the finished printed product.

According to a first embodiment of the method according to the invention, for each raster system that is used on the printed sheet, a separate dot gain correction curve 21 is produced, which places the half tone percentages Ps of the standard raster on which the reproduction system is based, and the exposed raster point sizes Pr of the raster actually printed in a relationship. These dot gain correction curves 21, together with the coarse color-value image data 10, are transmitted to the unit for area coverage calculation 11. So that the unit for area coverage calculation 11 can use the dot gain correction curves 21 to correct the coarse color-value image data 10, it is additionally necessary to transmit the information about in which regions of the printed sheet which raster system is printed or which of the dot gain correction curves 21 is to apply in the respective regions. According to the present invention, for such a purpose, the information about the local assignment of the dot gain correction curves 21 is transmitted to the unit for area coverage calculation 11 as separate correction location data 22. The data format used therefor can be chosen as desired. For example, the data format of a "coarse image" with one byte for each image point and with the same resolution as the coarse color-value image data 10 can be chosen, in which the bytes do not represent color values but a number for identifying the raster system used at the respective image point or for identifying the dot gain correction curve 21 to be applied. If there is a maximum of 16 different raster systems on the printed sheet, then, for example, a four-bit value for each image point is also sufficient for identifying the raster system. The correction location data 22 can also be embedded in the coarse color-value image data 10, for example, by inserted command words that identify a change in the raster system in an image line. This embedded form of the correction location data 22 is advantageous, in particular, when the coarse color-value image data 10 are transmitted in compressed form using run-length coding.

Figure 5:
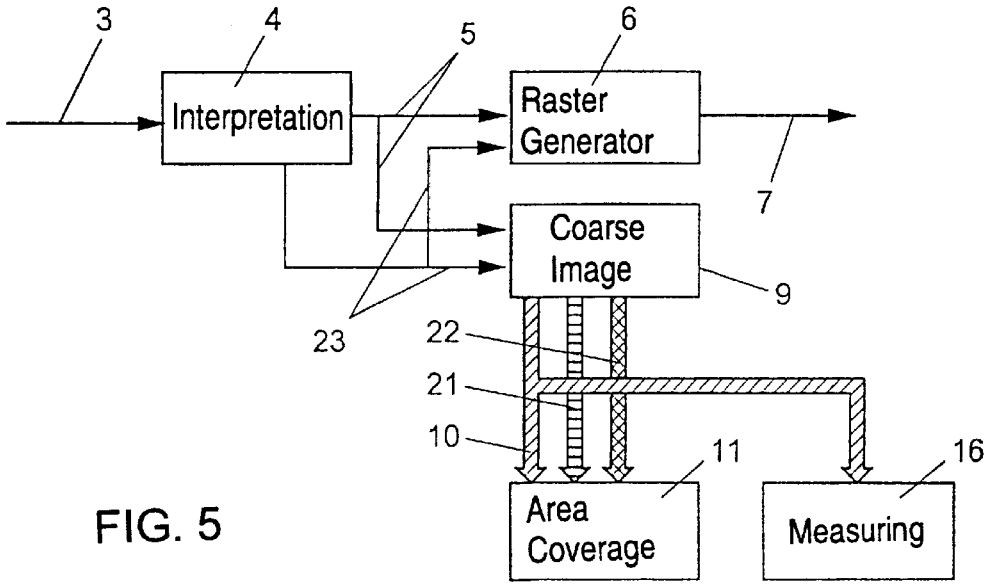
FIG. 5 is a block circuit diagram of a working sequence for determining the area coverage according to a first embodiment of the invention.

FIG. 5 illustrates the transmission of the various items of information, regardless of the data format used for this, from the unit for coarse image production 9 to the unit for area coverage calculation 11. The three parts of the information that, in accordance with the present invention, are used to determine the area coverages, are identified by differently hatched arrows. The color-value printing data 5 produced by the interpretation system 4 are used to produce the coarse color-value image data 10, by the color-value printing data 5 being reduced in terms of resolution by averaging. As already explained, the coarse color-value image data 10 represent the colors to be achieved in the finished printed product. They are, therefore, also transferred to the measuring system 16 in the control desk of the printing press 15, as predefinition values for the target colors. In addition, the interpretation system 4 derives from the printed sheet data 3 raster system data 23, which describe which raster systems are used on the printed sheet and where on the printed sheet which raster system is used. The properties of these raster systems, including also the dot gain of the raster systems in the print, have been stored in advance in the unit for coarse image production 9. By comparing the dot gain of the raster systems used for the exposure of the printing plate with the dot gain of the standard raster system on which the reproduction is based, the dot gain correction curves 21 for the raster systems are produced, as already described. From the location information in the raster system data 23, the correction location data 22 are produced and converted into the data format chosen for the transmission to the unit for area coverage calculation 11. The raster system data 23 is, likewise, led to the raster generator 6, so that when producing the rastered printing data 7 in the various regions of the printed sheet, the raster generator 6 can in each case take account of the dot gain correction belonging to the raster system used there.

Figure 6:
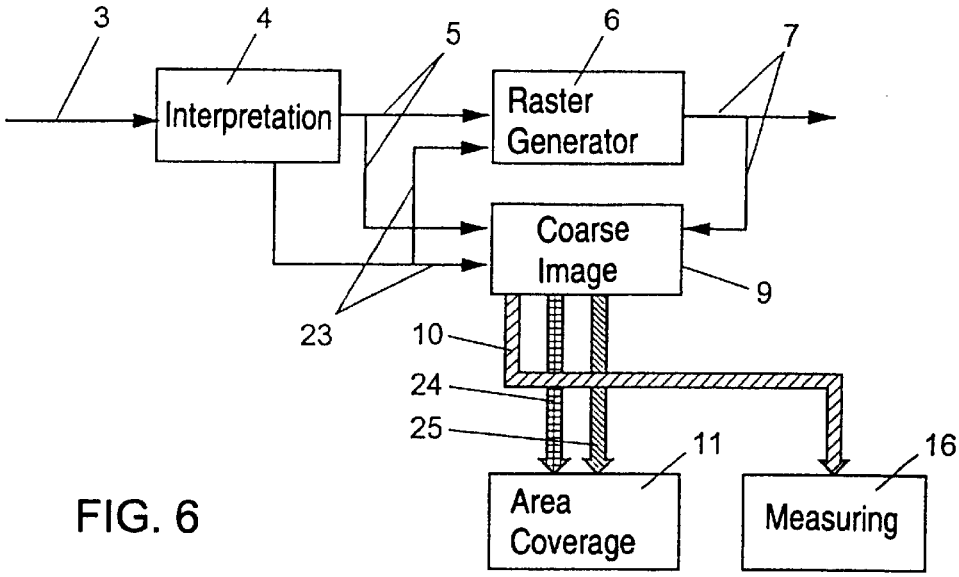
FIG. 6 is a block circuit diagram of the working sequence for determining the area coverage according to a second embodiment of the invention.

FIG. 6 shows a further embodiment of the method according to the invention. The coarse color-value image data 10 that has been produced from the color-value printing data 5 and that represents the colors to be achieved in the finished printed product is transferred only to the measuring system in the control desk of the printing press 15 as predefinition values for the target colors. From the rastered printing data 7, by averaging over the bitmap, coarse raster image data 24 is produced, which is transmitted to the unit for area coverage calculation 11. If no linearization of the exposer 8 is carried out, the coarse raster image data 24 for each coarse image point directly represents the size of the raster points exposed in the associated printing-plate region. This means that the additional information as to which raster system was used at which point in the printed sheet is not needed, and the coarse raster image data 24 in the unit for area coverage calculation 11 can be added up directly over the inking zone strips to derive the area coverage data 12.

Figure 7:
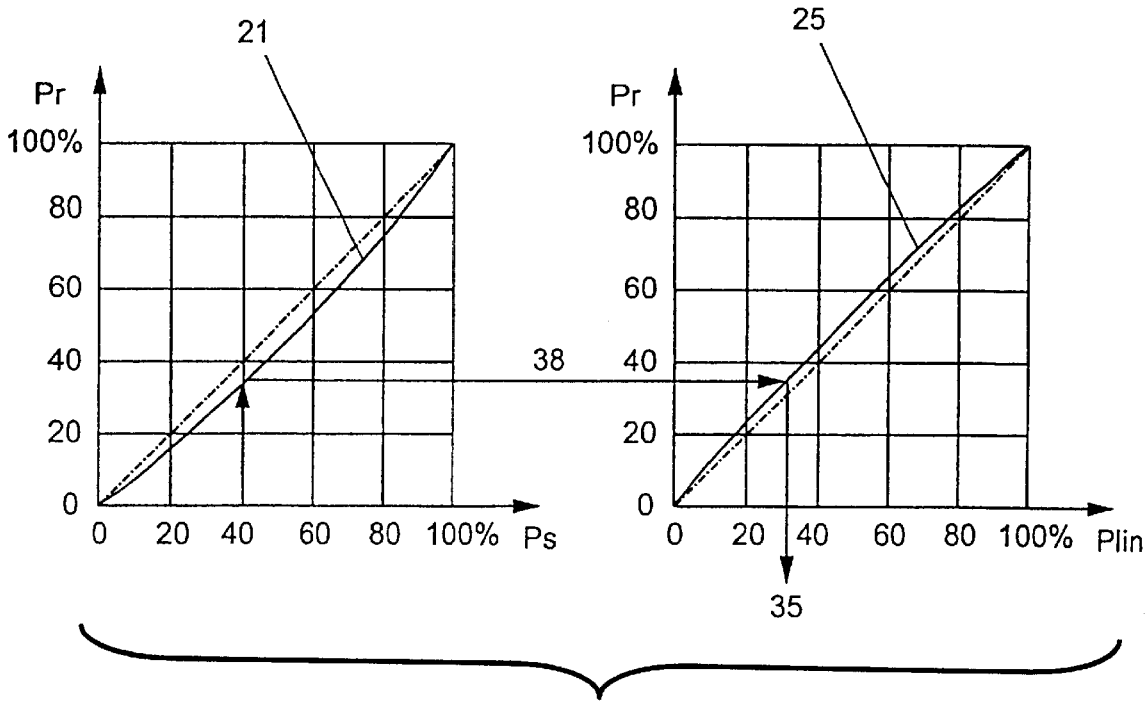
FIG. 7 is a graph illustrating the application of the dot gain correction curve and the linearization correction curve according to the invention.

In practice, however, linearization of the exposer 8 is always performed, and, therefore, has to be taken into account when evaluating the coarse raster image data 24. To this end, FIG. 7 shows the dot gain correction curve 21 and the linearization correction curve 25, which are applied one after another to the color-value printing data 5 in the raster generator 6 in order to obtain the rastered printing data 7 such that the correct raster point sizes, corrected with respect to the dot gain, are exposed. With the aid of the dot gain correction curve 21, first of all, a half tone percentage of, for example, Ps=40%, predefined by the reproduction system based upon the standard raster, is corrected to the raster point size Pr=38% to be exposed, in order to compensate for the dot gain, increased in the print, of the raster system actually used at the relevant point of the printed sheet. Because the exposer 8 has a nonlinear exposure characteristic, the raster point size Pr=38% to be exposed is corrected with the aid of the linearization correction curve 25 to the value Plin=35%. With such a value, a raster point with a size 35% is produced by the raster generator 6 in the bitmap of the rastered printing data 7. Using this bitmap as input variable for the exposer 8, a raster point of the desired size Pr=38% is, then, actually exposed, because of the nonlinearity of the exposer 8. In FIG. 7, it should be noted that in the linearization correction curve 25, the vertical axis represents the input value Pr and the horizontal axis represents the corrected output value Plin.

Because of the application of the linearization correction curve 25 in the raster generator 6, the rastered printing data 7 does not reproduce the raster point sizes Pr actually exposed. Therefore, in this embodiment of the method according to the invention, provision is made to transmit the linearization correction curve 25 additionally to the unit for area coverage calculation 11 (see FIG. 6). Using the linearization correction curve 25, the raster point sizes Plin reproduced by the rastered printing data 7 and from which the coarse raster image data 24 are derived, can be back-calculated again to the raster point sizes Pr actually exposed, before the area coverage data 12 is determined.

In an alternative embodiment, the method according to the invention can also be used in connection with a digital printing press, in which the printing plate exposure is integrated into the printing press 15. In such a printing press 15, to prepare for printing, unexposed printing plates are clamped onto the plate cylinder and, then, exposed in the printing press 15. In the event, the rastered printing data 7 are transmitted directly to the digital printing press 15 instead of to the exposer 8. Because this form of digital printing press is an offset printing press and has inking units divided up into inking zones, the method according to the invention can be used for determining the inking zone data 14 from the area coverage data 12.

We claim:

1. A method for producing a printing plate, which comprises:

determining area coverages of the printing plate for controlling quantities of ink in inking zones of a printing press by:

producing color-value printing data from existing printed-sheet data based upon a standard raster system;

converting the color-value printing data into rastered printing data with a raster generator;

exposing the rastered printing data onto one of film material and the printing plate with an exposer;

utilizing various raster systems with different dot gains on the printing plate;

dependent upon a raster system used, applying in the raster generator an associated dot gain correction curve and a linearization correction curve to the color-value printing data, the associated dot gain correction curve describing a change in a dot gain between the standard raster system and the raster system used, the linearization correction curve describing a relationship between raster point sizes in the rastered printing data and the raster point sizes exposed; and determining the area coverages of the printing plate in a unit for area coverage calculation, the unit for area coverage calculation being supplied with:

coarse color-value image data derived from the color-value printing data;

a dot gain correction curve for each raster system used; and correction location data describing which raster system is used in given areas of the printing plate.

2. The method according to claim 1, wherein the correction location data for each image point contains an identifier regarding which raster system is used in the image point.

3. The method according to claim 2, which further comprises transmitting the coarse color-value image data to a measuring system on the printing press as predefinition values for colors to be achieved in a print.

4. The method according to claim 1, which further comprises embedding the correction location data in the coarse color-value image data.

5. The method according to claim 4, which further comprises transmitting the coarse color-value image data to a measuring system on the printing press as predefinition values for colors to be achieved in a print.

6. The method according to claim 1, which further comprises transmitting the coarse color-value image data to a measuring system on the printing press as predefinition values for colors to be achieved in a print.

7. The method according to claim 1, which further comprises integrating the exposer into the printing press.

8. A method for producing a printing plate, which comprises:

determining area coverages of the printing plate for controlling quantities of ink in inking zones of a printing press by:

producing color-value printing data from existing printed-sheet data based upon a standard raster system;

converting the color-value printing data into rastered printing data with a raster generator;

exposing the rastered printing data onto one of film material and the printing plate with an exposer;

utilizing various raster systems with different dot gains on the printing plate;

dependent upon a raster system used, applying in the raster generator an associated dot gain correction curve and a linearization correction curve to the color-value printing data, the associated dot gain correction curve describing a change in a dot gain between the standard raster system and the raster system used, the linearization correction curve describing a relationship between raster point sizes in the rastered printing data and the raster point sizes exposed; and determining the area coverages of the printing plate in a unit for area coverage calculation, the unit for area coverage calculation being supplied with:

coarse raster image data derived from the rastered printing data; and the linearization correction curve.

9. The method according to claim 8, which further comprises integrating the exposer into the printing press.

* * * * *